US006557983B1

(12) United States Patent
Inoue

(10) Patent No.: US 6,557,983 B1
(45) **Date of Patent: *May 6, 2003**

(54) INK JET HEAD, SUBSTRATE FOR INK JET HEAD, INK JET CARTRIDGE, AND INK JET APPARATUS

(75) Inventor: Takashi Inoue, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/704,104

(22) Filed: Aug. 28, 1996

(30) Foreign Application Priority Data

Aug. 30, 1995 (JP) ..... 7-221813

(51) Int. Cl.[7] ..... B41J 2/05
(52) U.S. Cl. ..... 347/65
(58) Field of Search ..... 347/65, 63, 56, 347/54, 20, 1, 93

(56) References Cited

U.S. PATENT DOCUMENTS 4,896,171 A 1/1990 Ito
4,914,562 A * 4/1990 Abe et al. ..... 347/65
5,204,690 A * 4/1993 Lorenze, Jr. et al. ..... 347/93
5,317,346 A 5/1994 Garcia
5,322,594 A * 6/1994 Bol ..... 156/634
5,666,140 A 9/1997 Mitani et al. ..... 347/12
5,896,154 A 4/1999 Mitani et al. ..... 347/102

FOREIGN PATENT DOCUMENTS

EP 0613780 9/1994
EP 0627318 12/1994
EP 0646463 4/1995

* cited by examiner

*Primary Examiner*—John Barlow
*Assistant Examiner*—Michael S. Brooke
(74) *Attorney, Agent, or Firm*—Fitzpatrick, Cella, Harper & Scinto

(57) ABSTRACT

An ink jet head includes ink discharge openings for discharging ink and a substrate having a plurality of rows in each of which a plurality of electrothermal converting elements for generating thermal energy for discharging ink from the discharge openings are provided and having an ink supply opening between the rows of the plurality of electrothermal converting elements corresponding to length of the row. Portions of the substrate having the row disposed the plurality of electrothermal converting elements are connected to each other by a member having a thermal conductivity coefficient nearly equal to or higher than that of the substrate.

12 Claims, 9 Drawing Sheets

INK JET HEAD, SUBSTRATE FOR INK JET HEAD, INK JET CARTRIDGE, AND INK JET APPARATUS

BACKGROUND OF THE INVENTION

1. Field of the Invention

The present invention relates to an ink jet head, a substrate for ink jet head, an ink jet cartridge, and an ink jet apparatus.

2. Related Background Art

The ink jet recording apparatus conducts recording with a non-impact recording system. The ink jet recording apparatus has characteristics of high speed ink recording, possibility of recording on various recording mediums, and generation of no or little noise. Because of such characteristics, ink jet apparatuses are widely used as a recording mechanism in printers, word processors, facsimiles, copying machines, and so forth.

A typical ink jet recording method employs an electrothermal converting element, and conducts recording by discharging fine liquid droplets through a fine discharge opening onto a recording paper sheet. The ink jet recording head generally comprises an ink-ejecting device for forming liquid droplets and an ink-supplying system for supplying ink to the ink-ejecting device. For example, an ink jet recording head which has an electrothermal converting element in a pressurizing chamber discharges recording liquid droplets by bubbling pressure generated by foaming or boiling of the recording liquid caused by thermal energy given by electric pulses in accordance with recording signals.

The ink jet printer is a superior recording system as mentioned above. However, it involves a problem that the recorded image depends on a temperature of the ink jet recording head. For example, the quantity of ink discharge varies with the temperature of the recording head, resulting in a larger quantity of ink discharge at a higher ambient temperature as is well known. The temperature of the recording head becomes higher during recording, which varies the quantity of ink discharge to cause irregularity of printing density due to the temperature difference between at the beginning of printing and in the course of printing. To solve the problem, one method is elevation of the head temperature to a certain level by reference to the temperature information derived from one or more detection means such as diode sensors provided in the ink jet recording head. Another method is control of the recording liquid around the electrothermal converting element by application of small pulses not causing recording liquid discharge immediately before each discharge.

Such technical methods of temperature control are based on the assumption that the temperature distribution in the ink jet recording head is uniform, or the temperature at portions of the head remote from the sensor is nearly equal to the temperature around the sensor. However, in the recording head in which ink is supplied from an ink tank placed at the back of the substrate as shown in FIG. 8, depending on a type of ink supply opening, plural rows of electrothermal converting elements are thermally isolated from each other, and the heat generated by one row of electrothermal converting elements is not readily transferred to another row of converting elements. FIG. 9 is a front view of a substrate of an ink jet recording head of a prior art. The substrate carrying thereon electrothermal converting elements is usually made from a highly thermal conductive silicon. However, as can be seen from FIG. 9, the heat generated at the portion A is transferred to the portion B through the portions P and P'. Therefore, owing to low thermal conductivity from A to B, heat distribution is liable to become nonuniform in the ink jet recording head.

In an ink jet recording head, electric energy caused by applied pulses is converted by an electrothermal converting element into thermal energy. The thermal energy is not only converted to kinetic energy for discharging ink droplets but also released to the open air, transferred to ink, and remains in the ink jet recording head. The remaining heat is released later to the open air. However, a problem arises in usual printing in which ink droplets are discharged by continuous application of high frequency electric pulses to electrothermal converting elements. Because relaxation time for releasing the remaining heat is longer than cycle time of ink discharge, the heat is accumulated in the recording head and raises the temperature of the recording head. The accumulated heat causes the problem as below.

Initially the rise of temperature of an ink jet recording head causes change of the ink discharge rate, giving difference of record density between start of printing and just before end of printing. Secondly, frequency and timing of ink discharge varies among the ink jet recording elements when recording signals or electric pulses are applied in a usual manner. The variation of the frequency and timing of ink discharge results in nonuniform distribution of temperature in a recording head owing to the remaining heat. The nonuniform temperature distribution in a recording head causes variation of the amount and rate of discharge of the recording liquid among the ink jet recording elements constituting the ink jet recording head, whereby the recorded image deteriorates locally by the nonuniformity of recording density.

SUMMARY OF THE INVENTION

The present invention intends to provide an ink jet recording head which has uniform temperature distribution in entirety by diffusion of heat after ink discharge.

The present invention also intends to provide a substrate for an ink jet recording head, and an ink jet cartridge and an ink jet recording apparatus employing the ink jet recording head.

The ink jet head of the present invention comprises ink discharge openings for discharging ink and a substrate having a plurality of rows in each of which a plurality of electrothermal converting elements for generating thermal energy for discharging ink from the discharge openings are provided and having an ink supply opening between the rows of the plurality of electrothermal converting elements corresponding to length of the row, wherein portions of the substrate having the row disposed the plurality of electrothermal converting elements are connected to each other by a member having a thermal conductivity coefficient nearly equal to or higher than that of the substrate.

The present invention provides an ink jet recording head in which temperature distribution is uniform, and which is capable of forming images with less density irregularity caused by nonuniform distribution of temperature. Therefore, the number of temperature sensors conventionally equipped in the ink jet recording head can be reduced. In a preferred embodiment of the present invention, a wire mesh used as a heat transfer member of the recording head can also serve to remove dust from the recording liquid by filtration.

DESCRIPTION OF THE PREFERRED EMBODIMENTS

In the present invention, portions of the substrate for the rows of converting elements are connected by a member having a thermal conductivity coefficient nearly equal to or higher than the thermal conductivity coefficient of the substrate.

The material constituting the connecting member has a thermal conductivity coefficient nearly equal to the thermal conductivity coefficient of silicon (168 $W \cdot m^{-1} \cdot K^{-1}$ at 0° C., 800 $W \cdot m^{-1} \cdot K^{-1}$ at ordinary temperature) used generally as the substrate, preferably not less than 800 $W \cdot m^{-1} \cdot K^{-1}$, more preferably 1000 $W \cdot m^{-1} \cdot K^{-1}$ at ordinary temperature.

The electrothermal converting elements arranged in rows are separated by an ink supply opening, and are connected at one or more positions by a material having the aforementioned high thermal conductivity. The element rows may be connected in any type, and may be connected with one or more bridging members 6 between the element rows as in the ink jet recording head substrate shown in FIG. 1 employed later in Example 1.

Figure 4:
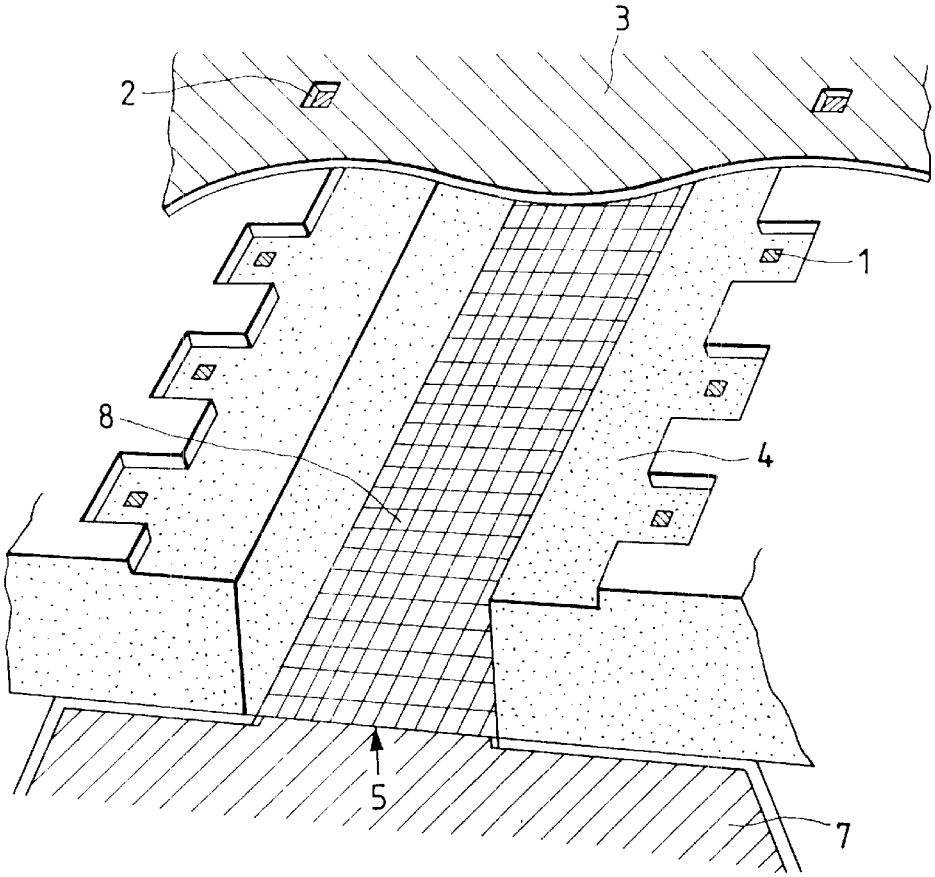
FIG. 4 is a cutaway view in perspective of the center, portion of a substrate of the ink jet recording head of Example 2.

Otherwise, the element rows may be connected with a metallic filter 8 for the recording liquid as shown in FIG. 4 employed later in Example 2. Such a metallic filter for the recording liquid is preferably attached directly to the substrate carrying the electrothermal converting elements thereon to achieve the object of the present invention surely. The metallic material therefor includes those having both the aforementioned thermal conductivity coefficient and resistance to corrosion by ink or other substances, specifically including gold, and iridium-tungsten alloys.

Figure 11:
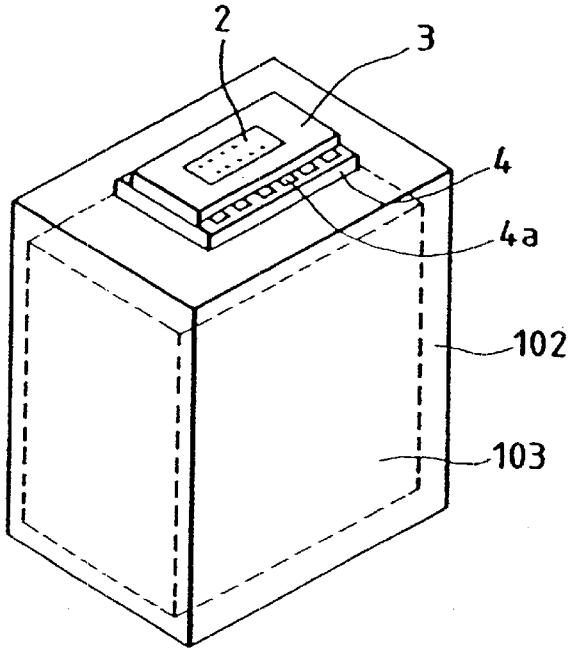
FIG. 11 is a perspective view of an ink jet cartridge having a head and an ink tank in integration of the present invention.

FIG. 11 is a perspective view of an ink jet cartridge of the present invention which has an ink jet head and an ink tank 102 provided with an ink chamber 103 for storing the ink to be supplied to the head in integration. The head and the ink tank may be integrated detachably or undetachably. A terminal 4*a* is provided at the end portion of the substrate 4 to supply electric energy to the electrothermal converting elements, and is connected electrically to a terminal on the apparatus side.

Figure 12:
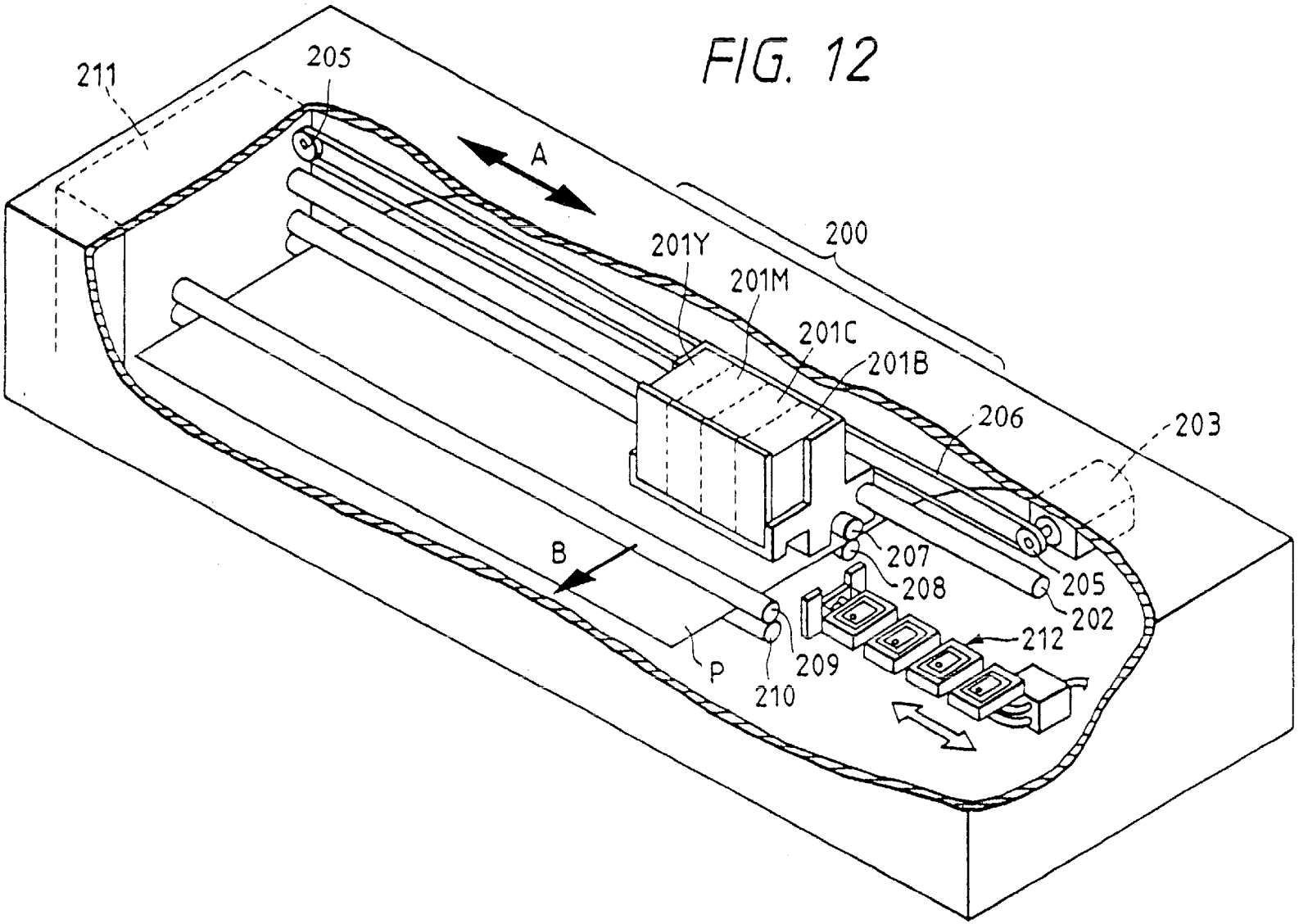
FIG. 12 is a partially cutaway view in perspective of the main portion of an ink jet apparatus equipped with an ink jet cartridge.

An example of a liquid discharging apparatus is explained below on which the liquid-discharging head is detachably mounted. FIG. 12 is a partially cutaway view in perspective of a liquid-discharging apparatus.

In FIG. 12, the reference numeral 200 indicates a carriage for setting the aforementioned liquid discharge head in a demountable manner. In this apparatus, four kinds of liquid-discharging heads are set corresponding to the colors of inks as the discharged liquids. The respective heads are mounted with a yellow ink tank 201Y, a magenta ink tank 201M, a cyan ink tank 201C, and a black ink tank 201B on the carriage 200.

The carriage 200 is supported by a guide shaft 202, and is moved in two directions on the guide shaft as shown by the arrow mark A by an endless belt 206 driven by a motor 203 rotating reversibly. The endless belt 204 is held by pulleys 205 and 206.

A recording paper sheet P as a medium to be recorded (recording medium) is delivered intermittently in the direction shown by the arrow mark B perpendicular to the arrow mark A. The recording paper sheet P is held by a pair of roller units 207, 208 at the sheet-feeding side and another pair of roller units 209, 210 at the sheet-releasing side under a certain tension, and is delivered in a plane state relative to the head. The respective roller units are driven by a driving mechanism 211, but may be driven by the aforementioned driving motor.

The carriage 200 stops at a home position when necessary at the start or during recording. At the home position, a capping member 212 is provided to cap a face of the discharge opening of the head, to which a recovery suction pump (not shown in the drawing) is connected to suck forcibly the discharge opening to prevent clogging of the discharge opening.

Figure 13:
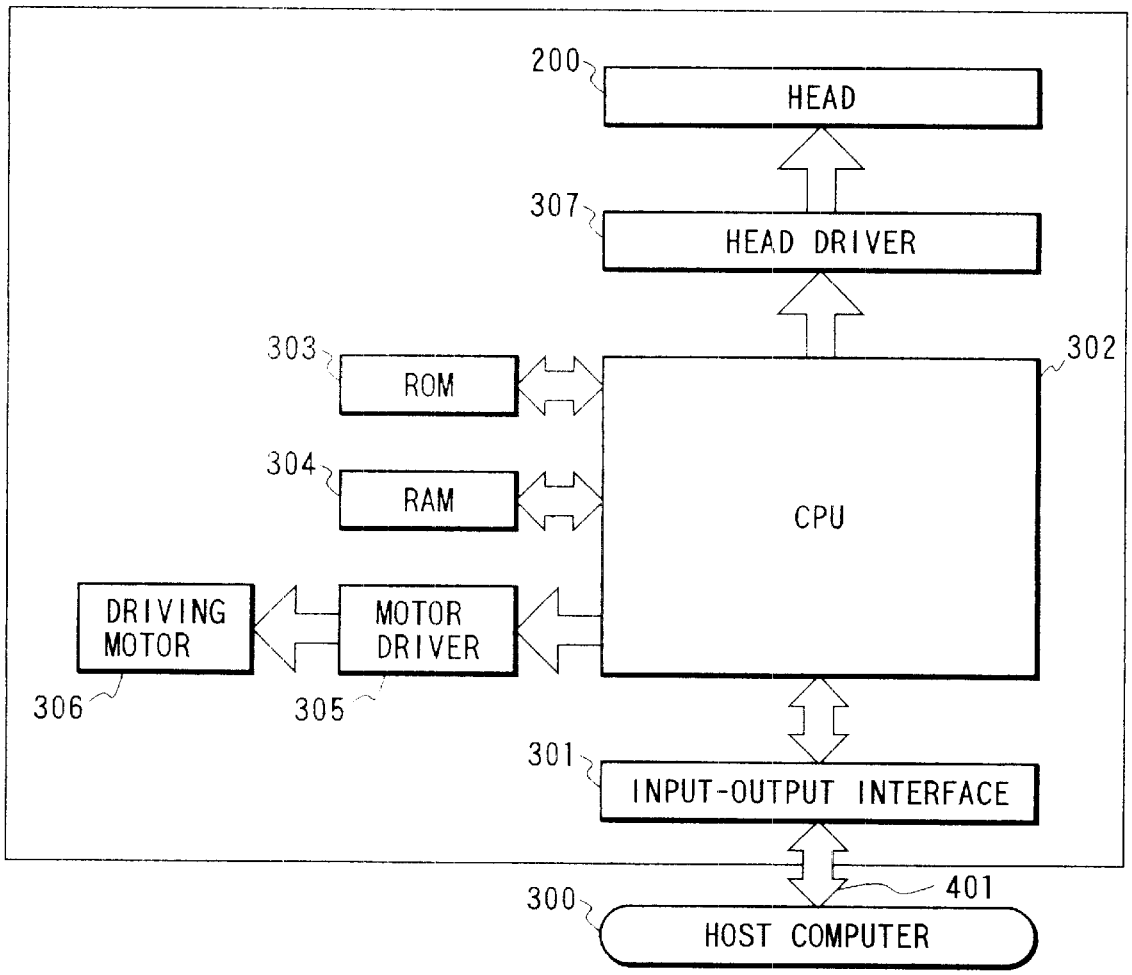
FIG. 13 is a block diagram for an ink jet apparatus.

FIG. 13 is a block diagram for operation of an entire liquid-discharging apparatus employing a liquid-discharging head of the present invention.

The recording apparatus receives printing information as control signal from a host computer 300. The printing information is stored temporarily in an input-output interface 301 in the printing apparatus, and is converted to data for processing in the recording apparatus. The converted data are inputted to CPU 302 serving also as a means for supplying head drive signals. The CPU 302 processes the inputted data according to the control program stored in ROM 303 by employing peripheral units of RAM 304 and the like to convert the inputted data into printing data (image data).

The CPU 302 also prepares driving data for driving the motor for moving the recording paper sheet and the recording head synchronously with the image data in order to record the image data on a suitable position on the recording paper sheet. The image data and the motor-driving data are transmitted through a head driver 307 and a motor driver 305 to the head 200 and the driving motor 306, thereby an image being formed in controlled timing.

The recording medium which is applicable to the above recording apparatus and is suitable for recording with a recording liquid such as an ink includes paper sheets, OHP sheets, plastic materials used for compact disks and ornament plates, cloths, metals such as aluminum and copper, leathers such as bovine hides, pig hides and artificial leathers, wood materials including wood and plywood, bamboo materials, ceramics such as tiles, and three-dimensional structures such as sponges.

The recording apparatus as mentioned above includes printer apparatuses for various paper sheets, OHP sheet or the like, plastic-recording apparatuses for plastic recording mediums such as compact disks, metal-recording apparatuses for metal plates, leather-recording apparatuses for leather mediums, wood-recording apparatuses for wood mediums, ceramic-recording apparatuses for ceramic mediums, recording apparatuses for sponges and other three-dimensional network structures, and dye-printing apparatuses for cloths.

The discharging liquid for the liquid-discharging apparatus is selected for the respective recording mediums and recording conditions.

An example of the ink jet recording system employing a liquid-discharging head as the recording head of the present invention is explained below.

Figure 14:
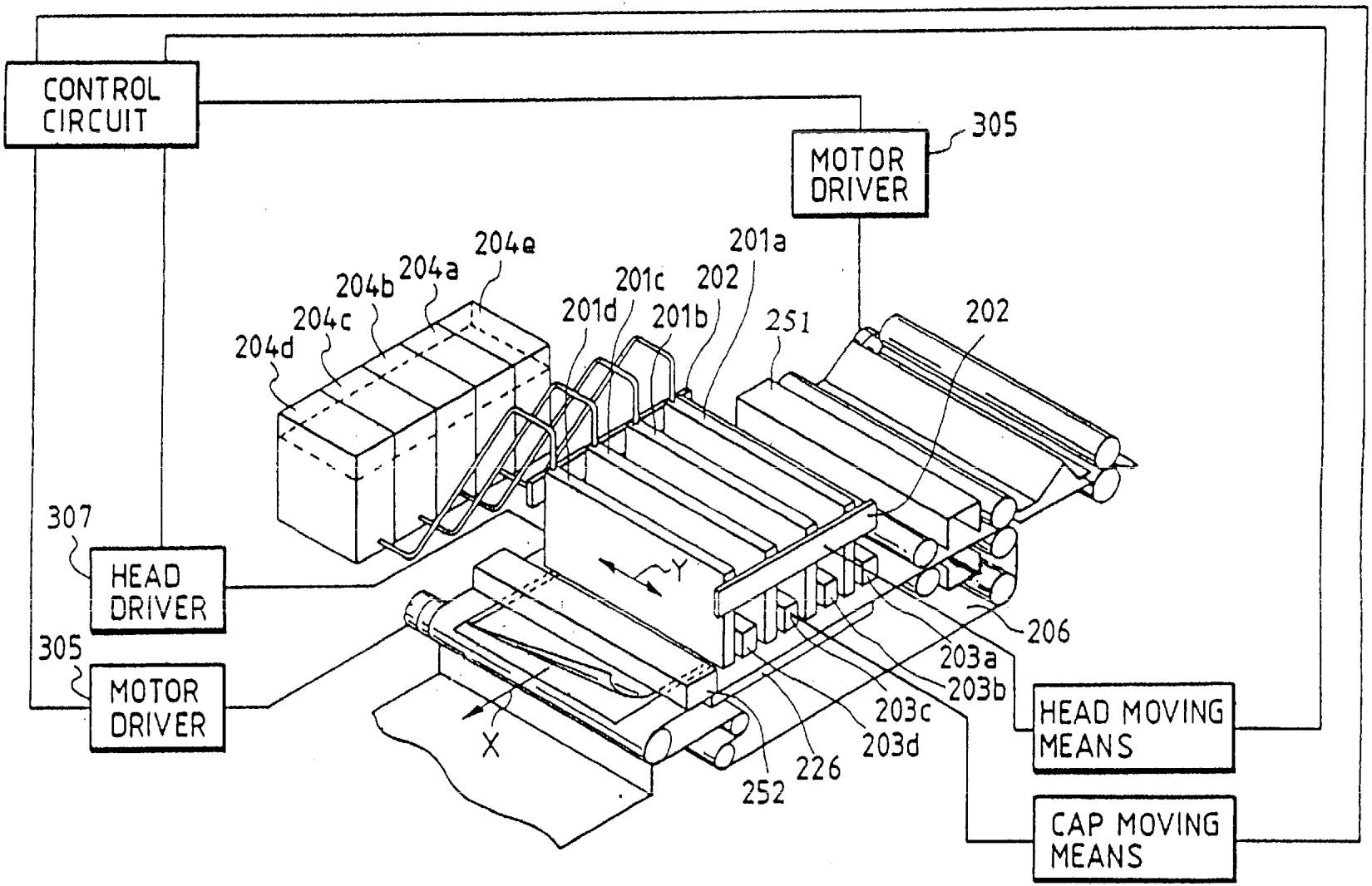
FIG. 14 is a perspective view of the main portion of an ink jet recording system.

FIG. 14 is a schematic perspective view for explaining an ink jet recording system employing the liquid-discharge head of the present invention. The liquid-discharge head in this embodiment is a full-line type head having plural discharge openings at 360 dpi spacing corresponding to the entire recording breadth of the recording medium, and comprises four heads 201*a–d* held by a holder 202 for four colors of yellow (Y), magenta (M), cyan (C), and black (Bk). The four heads are held by a holder 202 to be fixed in a predetermined intervals in parallel in X direction.

Signals are applied to the respective heads from a head driver 307 constituting a driving signal-supplying means. The respective heads are driven according to the signals.

To the respective heads, inks of four colors of Y, M, C, or Bk are fed from ink containers 204*a*–204*d*. From a blowing liquid container 204*e*, a blowing liquid is fed to the respective heads.

Below the respective heads, head caps 203*a*–203*d* are provided which have an ink-absorbing material like a sponge therein, and caps the discharge openings of the respective heads to maintain the heads while the recording is not conducted.

A delivery belt 206 constitutes the delivery means for delivering a recording medium as explained in the aforementioned embodiment. The delivery belt 206 is held by rollers through a predetermined path, and is driven by a driving roller connected to a motor driver 305.

In the ink jet type recording system of this embodiment, a pre-treatment device 251 and a post-treatment device 252 are provided in the recording medium delivery path for treating the recording medium before and after the recording.

The pre-treatment and the post-treatment are selected depending on the kind of the employed recording medium and the kind of the employed ink. For example, a recording medium such as metal, plastic, or ceramic may be exposed to ultraviolet ray irradiation and ozone atmosphere as the pre-treatment to activate the surface to improve adhesiveness of ink. A readily electrifiable recording medium such as plastics is liable to attract dust on the surface to impair the recording quality. Therefore, such a recording medium may be treated by an ionizer device to eliminate static electricity from the recording medium for removal of dust as the pre-treatment. The cloth as the recording medium may be pre-treated by application of an alkaline substance, a water-soluble substance, a synthetic polymer, a water-soluble metal salt, urea, or thiourea for the purpose of prevention of ink running and improvement of fixing ratio. The pre-treatment is not limited thereto, and may be temperature adjustment to make the temperature of the recording medium suitable for the recording.

The post-treatment includes ink-fixation acceleration treatment of ink-applied recording medium, such as heat treatment, and ultraviolet ray irradiation, and washing treatment, to remove an unreacted remaining treating agent having been used in the pre-treatment.

In this embodiment, a full-line head is explained as the head. However, the invention is not limited thereto, and may be a recording apparatus which has a small head moving in a breadth direction of a recording medium as mentioned before.

EXAMPLE 1

Figure 1:
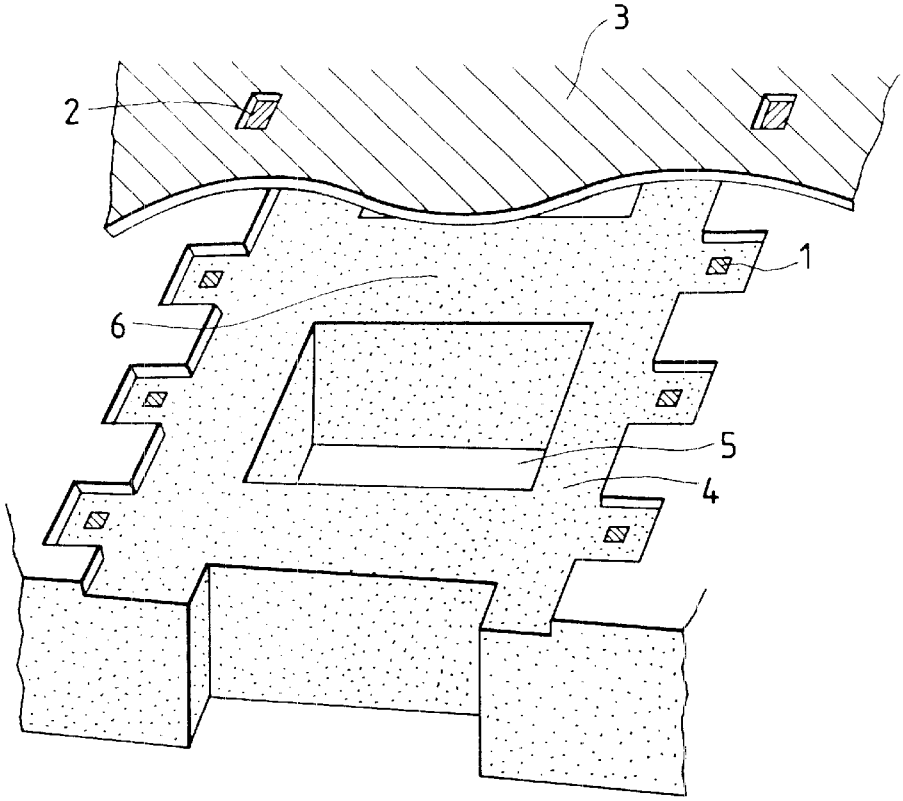
FIG. 1 is a cutaway view in perspective of the center portion of a substrate of the ink jet recording head of Example 1.

FIG. 1 is an enlarged cutaway view in perspective of the center portion of a substrate of an ink jet recording head of the present invention. This head was of a side shooter type, and discharge openings were provided on a plane opposing parallel to the plane of the pressure source. Electrothermal converting elements or piezo elements were provided on the substrate. Ink supply openings were provided through the substrate to communicate with an ink tank placed on the back surface of the substrate. As shown in FIG. 1, the ink supply openings have a cross-section that is substantially the same in the thickness direction of the substrate. The electrothermal converting elements or the piezo elements were arranged on the substrate with interposing the ink supply openings. In this Example, the material for the substrate-connecting portions was silicon, the same material as the substrate provided with the electrothermal converting elements. The breadth of the connecting portion was 60 $\mu$m, and the interval between the connecting portions was 100 $\mu$m. Since a broader breadth of the connecting portions retarded the supply of the recording liquid, the breadth was preferably approximate to the above dimensional order.

In FIG. 1, the reference numeral 1 indicates an electrothermal converting element; 2, a discharge opening; 3, a nozzle orifice plate; 4, a silicon substrate; 5, a supply opening; 6, a connecting portion characteristic of the present invention connecting the substrate portions 4 interposing the supply opening 5. An ink (recording liquid) fills the space between the nozzle orifice plate 3 and the silicon substrate 4. The ink is supplied from the back side of the silicon substrate.

Figure 2:
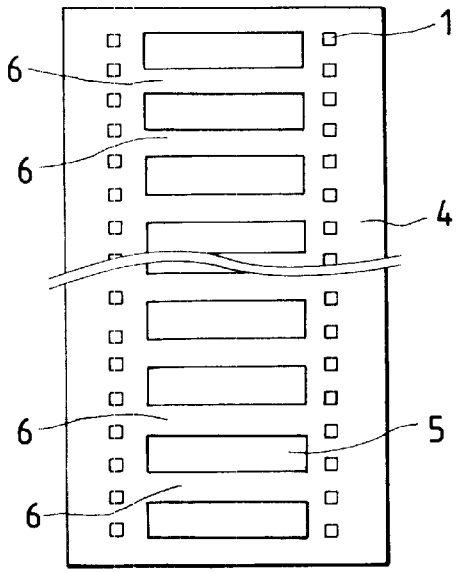
FIG. 2 is a front view of the entire of the substrate of the ink jet head of FIG. 1.
Figure 3:
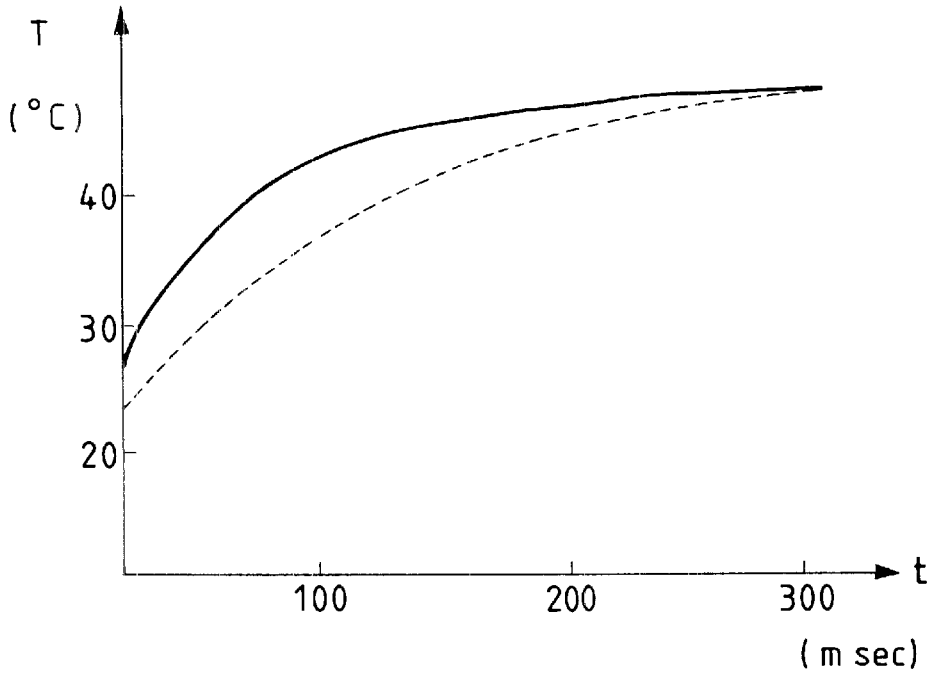
FIG. 3 is a graph showing temperature changes with time at the working nozzle row side and at the non-working nozzle row side when ink is discharged from one of the two rows of the nozzles of FIG. 1.
Figure 8:
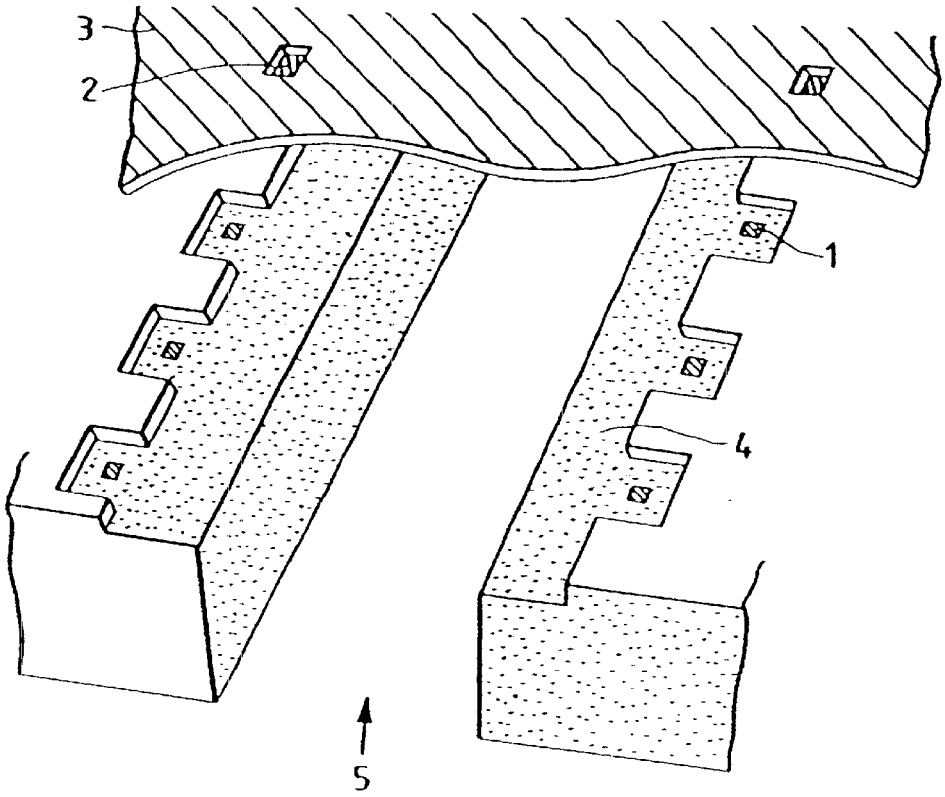
FIG. 8 is a cutaway view in perspective of the center portion of a substrate of the ink jet recording head of prior art.
Figure 9:
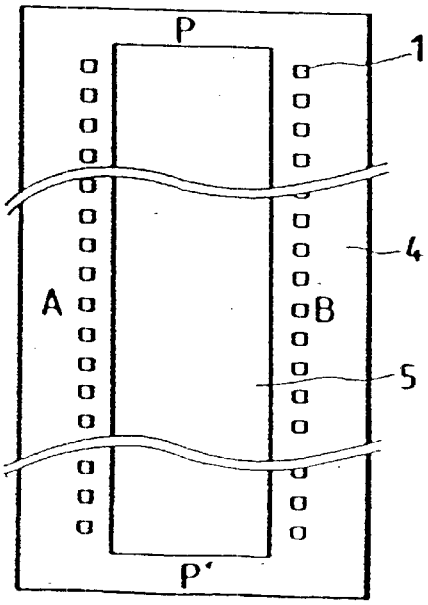
PRIOR ART FIG. 9
FIG. 9 is a front view of the entire of the substrate of the ink jet head of FIG. 8.
Figure 10:
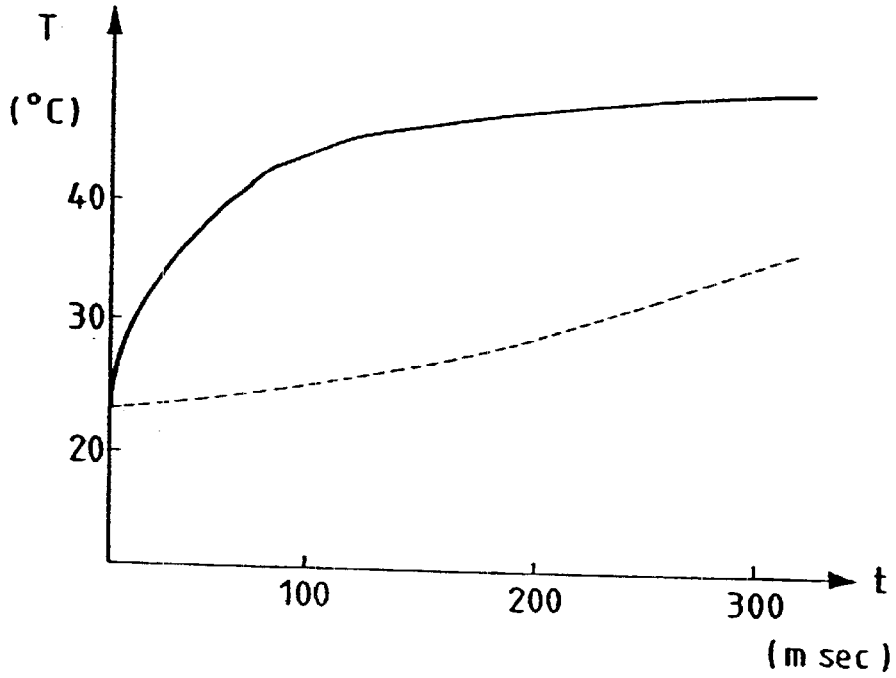
PRIOR ART FIG. 10
FIG. 10 is a graph showing temperature changes with time at the working nozzle row side and at the non-working nozzle row side when ink is discharged from one of the two rows of the nozzles of FIG. 8.

FIG. 2 shows the surface of the entire substrate viewed from the surface side. FIG. 3 is a graph showing temperature changes at a working element opening row side (shown by a solid line) and at a non-working element row side (shown by a dotted line) when ink is discharged continuously from only one of the two rows of the discharging openings. FIG. 10 is a graph showing the temperature changes with a conventional head as shown in FIGS. 8 and 9. Both of the above two ink jet recording heads employed 256 nozzles at 360 dpi spacing, and apparatus temperature sensors and head temperature sensors to control the head temperature. The driving frequency of the recording head was 10.0 kHz.

Comparing FIG. 3 with FIG. 10, the ink jet recording head of the present invention was excellent in thermal characteristics, and the temperature at the non-working discharge opening side was close to the temperature at the working discharge opening side. Thus the head readily made uniform in temperature distribution. In another experiment, solid printing was conducted with one of the two rows of nozzles, and immediately thereafter solid printing was further conducted by use of the other one row of nozzles. The optical density of the solid print came to be changed on the switchover of the printing nozzle row from 1.45 to 1.37 with the conventional head, and from 1.45 to 1.43 with the head of this Example. Thus the change was decreased with the head of the present invention.

EXAMPLE 2

FIG. 4 is an enlarged cutaway view in perspective of the center portion of a substrate of another ink jet recording head of the present invention. This head was of a side shooter type, and discharge openings were provided on a plane opposing parallel to the plane of the pressure source. Electrothermal converting elements or piezo elements were provided on the substrate. Ink supplying openings were provided through the substrate to communicate with an ink tank at the back side. The electrothermal converting elements or the piezo elements were arranged on the substrate with interposing the ink supplying openings. In this Example, the member for connecting the substrate portions was a metallic filter for filtering the recording liquid. The filter was made from gold, and the mesh width of the filter was 12 $\mu$m.

In FIG. 4, the reference numeral 1 indicates an electrothermal converting element; 2, a discharge opening; 3, a nozzle orifice plate; 4, a silicon substrate; 5, a supply opening; 7, an ink tank; 8, a metallic filter characteristic of the present invention connecting the substrate portions interposing the supply opening. An ink (recording liquid) fills the space between the nozzle orifice plate 3 and the silicon substrate 4. The ink is supplied from the back side of the silicon substrate.

Figure 6:
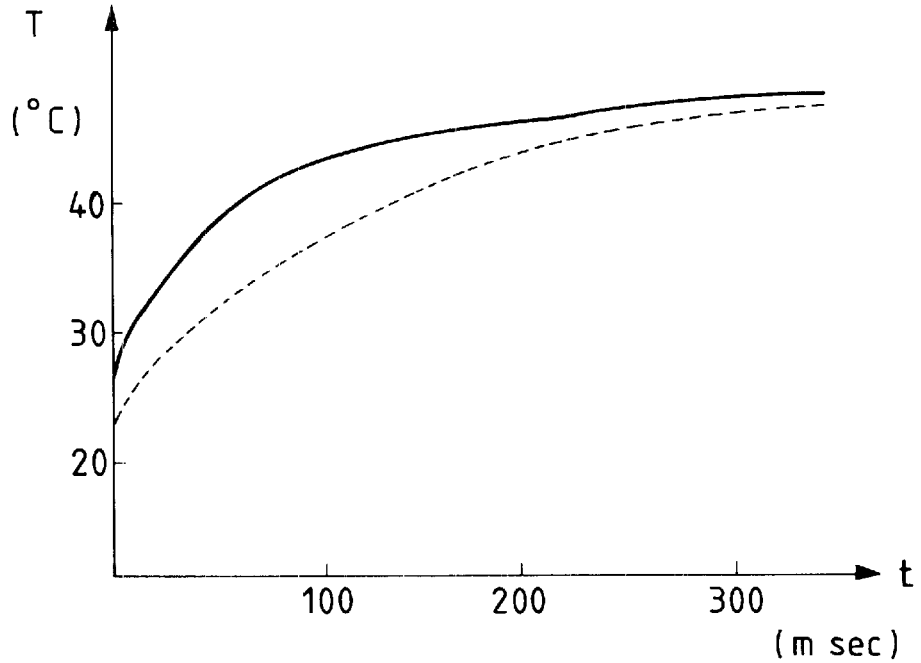
FIG. 6 is a graph showing temperature changes with time at the working nozzle row side and at the non-working nozzle row side when ink is discharged from one of the two rows of the nozzles of FIG. 4.
Figure 5:
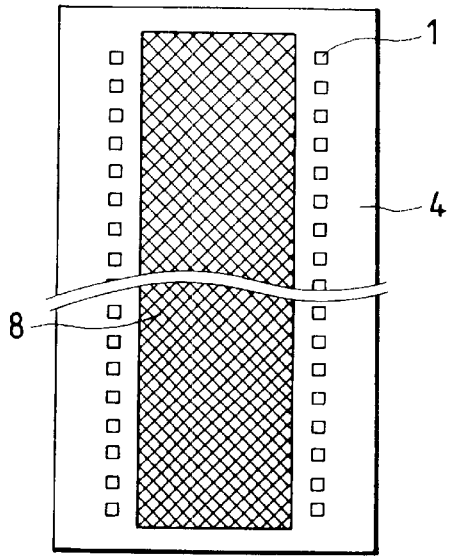
FIG. 5 is a front view of the entire of the substrate of the ink jet head of FIG. 4.

FIG. 5 shows the surface of the entire substrate viewed from the surface side. FIG. 6 is a graph showing temperature changes at a working element row side (shown by a solid line) and at a non-working element row side (shown by a dotted line) when ink is discharged continuously from only one of the two rows of discharging openings. The above ink jet recording head employed 256 nozzles in 360 dpi spacing, and apparatus temperature sensors and head temperature sensors to control the head temperature. The driving frequency of the recording head was 10.0 kHz.

Comparing FIG. 6 with FIG. 10, the ink jet recording head of the present invention was excellent in thermal characteristics, and the temperature at the non-working discharge opening side was close to the temperature at the working discharge opening side. Thus the head readily was made uniform in temperature distribution. In this Example also the same effects as in Example 1 were achieved. Further, the metallic filter of this Example served also to remove dust from the recording liquid.

EXAMPLES 3 AND 4

Figure 7A:
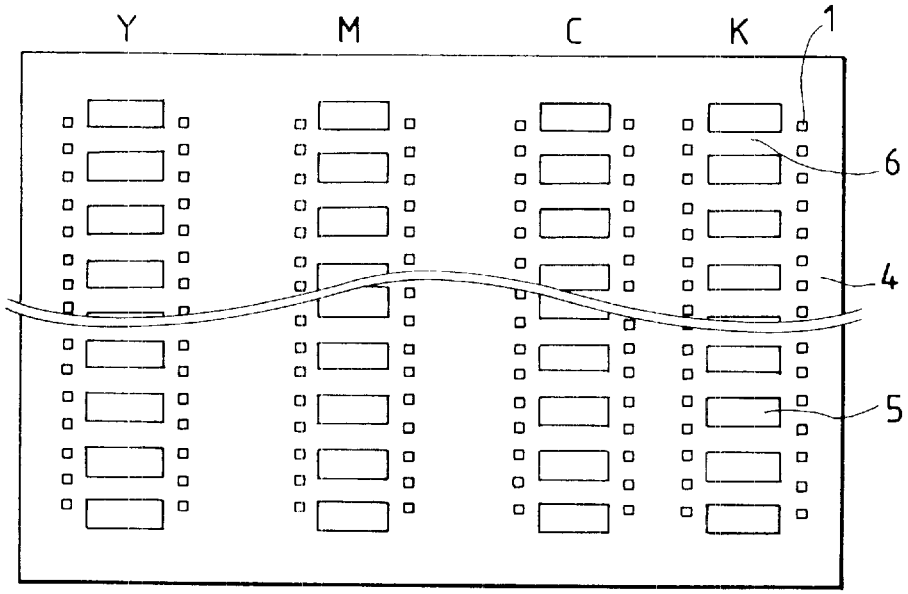
FIGS. 7A and 7B are front views of the color ink jet recording heads of Examples 3 and 4.
Figure 7B:
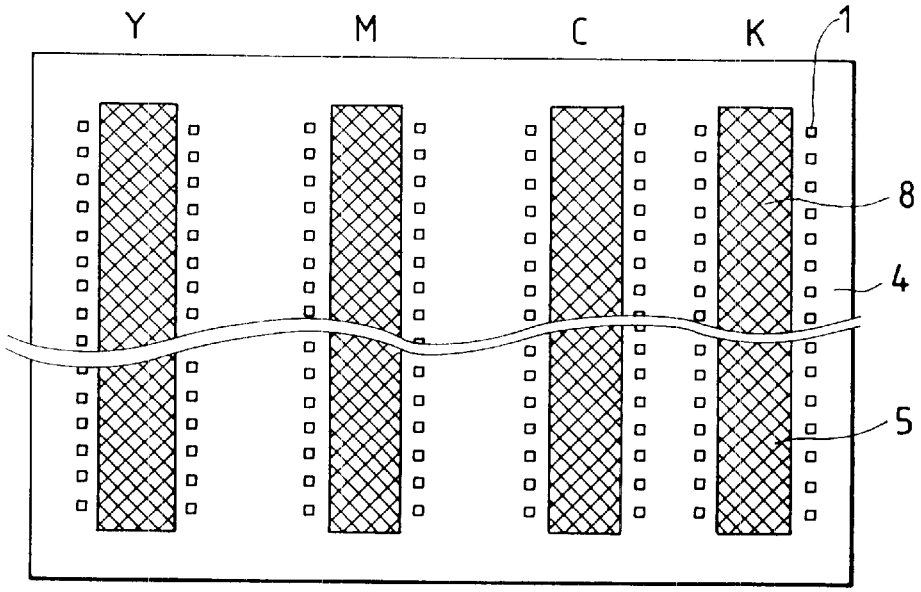

In Examples 1 and 2 above, the recording heads had two rows of electrothermal converting elements. The present invention is applicable to the recording heads having three or more rows of electrothermal transducers. In Examples 3 and 4, color ink jet recording heads of Y (yellow), M (magenta), C (cyan), and K (black) were employed which respectively have electrothermal converting elements on one and the same substrate, and the ink supply openings communicated with respective color ink tanks as shown in FIG. 7A and FIG. 7B. In FIG. 7A, connecting members were provided at the ink supply openings for respective color inks. In FIG. 7B, metallic filters 8 were provided at the ink supply openings. In these Examples, heat could be diffused also through the portion of the substrate between the ink supply openings 5 to uniformize the temperature distribution.

As explained above, according to the present invention an ink jet recording head is provided which has satisfactory ink discharging characteristics throughout all the electrothermal converting elements with uniform temperature distribution, and gives output without printing density uneveness. Further, by use of a metallic filter as the connecting member according to the present invention, an ink jet recording head is provided which requires no additional filter and has excellent temperature characteristics.

What is claimed is:

1. An ink jet head comprising a plurality of ink discharge openings for discharging ink and a substrate made from a material and having a plurality of rows in each of which a plurality of electrothermal converting elements for generating thermal energy for discharging ink from the discharge openings are provided, the ink jet head having an ink supply opening between the rows of the plurality of electrothermal converting elements corresponding to a length of the row, wherein portions of the substrate having the rows in which are disposed the plurality of electrothermal converting elements are connected to each other by a bridging member having a thermal conductivity coefficient nearly equal to that of the substrate, the bridging member being integrally formed from the material of the substrate, the bridging member dividing the ink supply opening for the ink into a plurality of openings only in a direction along the rows, which plural openings each have substantially a same cross-section in a thickness direction of the substrate.

2. The ink jet head according to claim 1, wherein the bridging member comprises Si.

3. The ink jet head according to claim 1, wherein a plurality of said ink supply openings are provided on a common substrate, and different inks are supplied to the respective ink supply openings.

4. A substrate for an ink jet ink jet head made from a material and having a plurality of electrothermal converting elements arranged in a plurality of rows, each row being disposed at a portion of the substrate, each of which rows contain a plurality of the electrothermal converting elements for generating thermal energy for discharging ink from a plurality of associated discharge openings, the ink jet head having an ink supply opening between the rows of the plurality of electrothermal converting elements corresponding to a length of the row, wherein the portions of the substrate having the rows in which are disposed the plurality of electrothermal converting elements are connected to each other by a bridging member having a thermal conductivity coefficient nearly equal to that of the substrate, the bridging member being integrally formed from the material of the substrate, the bridging member dividing the ink supply opening for the ink into a plurality of openings only in a direction along the rows, which plural openings each have substantially a same cross-section in a thickness direction of the substrate.

5. The substrate for an ink jet head according to claim 4, wherein the bridging member defines a filter integral to the substrate so as to cover the ink supply opening.

6. The substrate for an ink jet head according to claim 4, wherein the bridging member comprises Si.

7. An ink jet cartridge comprising: an ink jet head comprising a plurality of ink discharge openings for discharging ink and a substrate made from a material and having a plurality of rows in each of which a plurality of electrothermal converting elements for generating thermal energy for discharging ink from the discharge openings are provided, the ink jet head having an ink supply opening between the rows of the plurality of electrothermal converting elements corresponding to a length of the row, wherein portions of the substrate having the rows in which are disposed the plurality of electrothermal converting elements are connected to each other by a bridging member having a thermal conductivity coefficient nearly equal to that of the substrate, the bridging member being integrally formed from the material of the substrate, the bridging member dividing the ink supply opening for the ink into a plurality of openings only in a direction along the rows, which plural openings each have substantially a same cross-section in a thickness direction of the substrate; and an ink tank in fluid communication with the ink jet head for storing ink and supplying the ink through the ink supply opening to the ink jet head.

8. An ink jet apparatus having a mounting portion upon which is mounted an ink jet head, the ink jet head comprising a plurality of ink discharge openings for discharging ink and a substrate made from a material and having a plurality of rows in each of which a plurality of electrothermal converting elements for generating thermal energy for discharging ink from the discharge openings are provided, the ink jet head having an ink supply opening between the rows of the plurality of electrothermal converting elements corresponding to a length of the row, wherein portions of the substrate having the rows in which are disposed the plurality of electrothermal converting elements are connected to each other by a bridging member having a thermal conductivity coefficient nearly equal to that of the substrate, the bridging member being integrally formed from the material of the substrate, the bridging member dividing the ink supply opening for the ink into a plurality of openings only in a direction along the rows, which plural openings each have substantially a same cross-section in a thickness direction of the substrate.

9. An ink jet head comprising a plurality of ink discharge openings for discharging ink and a substrate made from a material and having a plurality of rows in each of which a plurality of electrothermal converting elements for generating thermal energy for discharging ink from the discharge openings are provided, the ink jet head having an ink supply opening between the rows of the plurality of electrothermal converting elements corresponding to a length of the row, wherein portions of the substrate having the rows in which are disposed the plurality of electrothermal converting elements are connected to each other by a bridging member integrally formed from the material of the substrate, the bridging member dividing the ink supply opening for the ink into a plurality of openings only in a direction along the rows, which plural openings each have substantially a same cross-section in a thickness direction of the substrate.

10. A susbtrate for an ink jet ink head made from a material and having a plurality of electrothermal converting elements arranged in a plurality of rows, each row being disposed at a portion of the substrate, each of which rows contain a plurality of the electrothermal converting elements for generating thermal energy for discharging ink from a plurality of associated discharge openings, the ink jet head having an ink supply opening between the rows of the plurality of electrothermal converting elements corresponding to a length of the row, wherein the portions of the substrate having the rows in which are disposed the plurality of electrothermal converting elements are connected to each other by a bridging member integrally formed from the material of the substrate, the bridging member dividing the ink supply opening for the ink into a plurality of openings only in a direction along the rows, which plural openings each have substantially a same cross-section in a thickness direction of the substrate.

11. An ink jet cartridge comprising: an ink jet head comprising a plurality of ink discharge openings for discharging ink and a substrate made from a material and having a plurality of rows in each of which a plurality of electrothermal converting elements for generating thermal energy for discharging ink from the discharge openings are provided, the ink jet head having an ink supply opening between the rows of the plurality of electrothermal converting elements corresponding to a length of the row, wherein portions of the substrate having the rows in which are disposed the plurality of electrothermal converting elements are connected to each other by a bridging member integrally formed from the material of the substrate, the bridging member dividing the ink supply opening for the ink into a plurality of openings only in a direction along the rows, which plural openings each have substantially a same cross-section in a thickness direction of the substrate; and an ink tank in fluid communication with the ink jet head for storing ink and supplying the ink through the ink supply opening to the ink jet head.

12. An ink jet apparatus having a mounting portion upon which is mounted an ink jet head, the ink jet head comprising a plurality of ink discharge openings for discharging ink and a substrate made from a material and having a plurality of rows in each of which a plurality of electrothermal converting elements for generating thermal energy for discharging ink from the discharge openings are provided, the ink jet head having an ink supply opening between the rows of the plurality of electrothermal converting elements corresponding to a length of the row, wherein portions of the substrate having the rows in which are disposed the plurality of electrothermal converting elements are connected to each other by a bridging member integrally formed from the material of the substrate, the bridging member dividing the ink supply opening for the ink into a plurality of openings only in a direction along the rows, which plural openings each have substantially a same cross-section in a thickness direction of the substrate.

* * * * *

UNITED STATES PATENT AND TRADEMARK OFFICE

CERTIFICATE OF CORRECTION

PATENT NO. : 6,557,983 B1
DATED : May 6, 2003
INVENTOR(S) : Takashi Inoue

It is certified that error appears in the above-identified patent and that said Letters Patent is hereby corrected as shown below:

Column 4,
Line 26, “belt 204” should read -- belt 206 --; and
Line 27, “pulleys 205” should read -- pulleys 205. -- and “and 206.” should be deleted.

Column 7,
Line 3, “readily” should read -- readily was --.

Column 8,
Line 43, “ink jet” (second occurrence) should be deleted.

Column 10,
Line 1, “ink” (second occurrence) should be deleted.

Signed and Sealed this

Twenty-fifth Day of May, 2004

JON W. DUDAS
*Acting Director of the United States Patent and Trademark Office*